US008066541B2

(12) United States Patent
Schuck

(10) Patent No.: US 8,066,541 B2
(45) Date of Patent: Nov. 29, 2011

(54) METHOD FOR PRODUCING A CONTACT PIN FOR A FLUORESCENT TUBE AND CONTACT PIN FOR A FLUORESCENT TUBE

(75) Inventor: Theo Schuck, Steinfeld (DE)

(73) Assignee: Willy Kreutz GmbH & Co. KG, Steinfeld (DE)

( * ) Notice: Subject to any disclaimer, the term of this patent is extended or adjusted under 35 U.S.C. 154(b) by 0 days.

(21) Appl. No.: 12/682,361

(22) PCT Filed: Aug. 8, 2008

(86) PCT No.: PCT/DE2008/001278

§ 371 (c)(1),
(2), (4) Date: Apr. 9, 2010

(87) PCT Pub. No.: WO2009/049575

PCT Pub. Date: Apr. 23, 2009

(65) Prior Publication Data

US 2010/0244653 A1 Sep. 30, 2010

(30) Foreign Application Priority Data

Oct. 15, 2007 (DE) ..... 10 2007 049 531

(51) Int. Cl.
*H01J 9/00* (2006.01)
*H01J 5/48* (2006.01)

(52) U.S. Cl. ..... 445/26; 313/318.01; 313/318.12

(58) Field of Classification Search ..... 445/26, 445/27; 313/318.01, 318.03, 318.05, 318.07, 313/318.09, 318.12

See application file for complete search history.

(56) References Cited

U.S. PATENT DOCUMENTS 2,438,075 A 3/1948 Smith
2,454,326 A 11/1948 Makenny
2,841,690 A 7/1958 Kuebler (Continued)

FOREIGN PATENT DOCUMENTS

DE 1 221 726 A 9/1963

(Continued)

OTHER PUBLICATIONS

International Search Report Under Date of Jan. 21, 2009 in connection with PCT/DE2008/001278.

*Primary Examiner* — Bumsuk Won
(74) *Attorney, Agent, or Firm* — Quarles & Brady LLP

(57) ABSTRACT

The present invention relates to a method for producing a contact pin (01) for use as an electric contact element of a fluorescent tube, wherein the contact pin has a recess (06) extending along the longitudinal axis (05) thereof, wherein a connection wire of the fluorescent tube can be inserted into said recess and can be electrically connected to the contact pin (01), wherein the outer wall of the contact pin (01) has a cylindrical contact region (17) which can be engaged in a base bracket of the fluorescent tube in order to establish an electrical contact between the base bracket and the fluorescent tube, and wherein the outer wall of the contact pin (01) has an annular collar (08) with which the contact pin rests against the wall (04) of an end cap (02) when inserted into a recess of the end cap (02) which is provided on the axial end of the fluorescent tube.

29 Claims, 3 Drawing Sheets

U.S. PATENT DOCUMENTS

| | | | | |
|---|---|---|---|---|
| 3,470,603 | A | 10/1969 | Azzariti | |
| 4,854,888 | A * | 8/1989 | Cannon | 439/236 |
| 6,002,200 | A | 12/1999 | Keim et al. | |
| 2005/0136754 | A1 | 6/2005 | Wilson et al. | |

FOREIGN PATENT DOCUMENTS

| | | |
|---|---|---|
| DE | 71 475 | 8/1966 |
| EP | 0 982 410 A1 | 3/2000 |
| GB | 688 920 A | 3/1953 |

* cited by examiner

METHOD FOR PRODUCING A CONTACT PIN FOR A FLUORESCENT TUBE AND CONTACT PIN FOR A FLUORESCENT TUBE

CROSS REFERENCE TO RELATED APPLICATIONS

This application represents the national stage application of International Application PCT/DE2008/001278 filed 08 Aug. 2008, which claims priority of German Patent Application 10 2007 049 531.7 filed 15 Oct. 2007, which are incorporated herein by reference in their entirety for all purposes.

The present invention relates to a method for producing a contact pin for use as an electric contact element of a fluorescent tube according to the preamble of claim 1.

Moreover, the present invention relates to a contact pin such as can be produced in particular using the inventive method.

Known fluorescent tubes feature end caps respectively provided at the axial ends thereof, wherein the end caps are respectively provided with two contact pins. Said contact pins serve as electric contact elements with which the fluorescent tube is fastened and electrically contacted in base brackets. In generic contact pins, a recess is provided which extends along the longitudinal axis and into which a connection wire of the fluorescent tube can be inserted, by means of which connection wire the fluorescent tube is supplied with a voltage. The connection wire is electrically contacted with the contact pin subsequent to insertion into the recess of the contact pin, which can be performed in particular by sleeving. The outer wall of the contact pin has a cylindrical contact region which is electrically contacted in the base bracket when the fluorescent tube is activated. Moreover, an annular collar protruding beyond the cylindrical contact region is disposed on the outer wall of the contact pin. Said collar serves as a form-fitting stopper in order to readily enable assembly and fixing of the contact pin in the end cap. The end cap has a recess for each contact pin, the diameter of the recess being somewhat larger than the diameter of the cylindrical contact region of the contact pin. During assembly of the contact pin, one end of the contact pin is inserted into the recess of the end cap until the formed collar rests against the end cap.

For producing the known contact pins, a semi-finished metal product which is made of a brass material is used. Contact pins of the generic type are small parts to be manufactured in mass production, so that large quantities have to be produced in the shortest possible time. However, by using brass as a basic material for manufacturing the contact pins, the attainable maximum production speed is limited, since brass can only be processed at a limited production speed using known production processes.

Hence, it is an object of the present invention to suggest a novel method for producing contact pins for use in fluorescent tubes, which enables to further increase production speed. It is another object of the present invention to suggest a novel contact pin which can be produced at maximum possible production speeds, in particular using the novel method.

These objects are attained by a method and a contact pin according to the teaching of the two independent main claims.

Advantageous embodiments of the present invention are the subject-matter of the dependent claims.

The inventive method is based on the fundamental idea that a semi-finished metal product composed of an aluminum alloy is used for producing the contact pin. Another essential aspect of the inventive production method is that the shaping of the contact pin subsequent to cutting to length the semi-finished metal product is performed in principle in two separate process steps. In the first process step, the cut-to-length part of the semi-finished metal product is initially deformed, wherein, as a result of said deformation, at least the collar protruding beyond the diameter of the contact region is formed. By means of deforming the semi-finished metal product it is possible to form the protruding collar at the semi-finished metal product, so that a semi-finished metal product having a diameter corresponding to the diameter of the cylindrical contact region can be used as a basic material. In this way metal abrasion at the outer circumference of the contact pin can substantially be dispensed with.

In order to form the recess in the interior of the contact pin, the contact pin is then machined in a subsequent second process step.

By means of the combined deformation and machining of the semi-finished metal product made of an aluminum alloy, extremely high production speeds can be attained. Moreover, by means of the inventive method contact pins of supreme quality and with excellent electrical properties can be produced. In this context, in semi-finished metal products it is particularly advantageous to use a wire, since wires are available at a low cost with accordingly well-dimensioned diameters. Moreover, the essentially endless semi-finished wire product enables quasi-continuous processing and production of the contact pins.

The type of deformation process employed for forming the collar protruding at the outer circumference of the contact pin is basically optional. Cold deformation processes have proven to be particularly suitable. In particular upsetting the cut-to-length semi-finished metal product is very well suited for forming the protruding collar.

In order to ensure good machinability of the contact pin during assembly at the end cap and during contacting at the base bracket, the protruding collar should be deformed preferably on one side with a conical flank and on the opposite side with a planar flank or else with a second conical flank. By means of the planar flank, reliable positioning of the contact pin is ensured when the collar rests against the wall of the end cap.

In order to avoid twisting of the contact pins relative to the end cap, whereby the contact wires of the fluorescent tube may twist off, a form-fitting and force-fitting engagement should be provided between the planar flank of the collar at the contact pin and the opposite wall of the end cap. In order to allow for this aspect, protruding teeth can be readily formed at the planar flank of the collar by means of the deformation process. In the light of the fact that the formation of the protruding teeth is performed in the course of the deformation process of the aluminum alloy material, no considerable additional costs are incurred as a consequence.

The material removed from the semi-finished metal product as a result of the machining process can only be further utilized as metal waste and is thusly practically useless. In order to reduce the amount of chip waste produced as a result of the machining process, according to a preferred method variation, a part of the recess cannot be produced by machining but rather by deforming. This means that in the course of the production step for deforming the semi-finished metal product not only the protruding collar at the outer surface of the cut-to-length semi-finished metal product is formed, but likewise at least a part of the recess extending along the interior of the longitudinal axis of the contact pin is produced with the aid of material extrusion. In particular by using backward extrusion, at the frontal surfaces of the initially still massive semi-finished metal product one or two cups can be created by deformation.

In order to attain the desired production efficiencies, upon completion of the deformation of the semi-finished metal product, a drilling process should be performed to form the recess. The drilling process enables very high production efficiency, especially when the drilling process is performed at a rotational speed of more than 10,000 r/min, for instance at a rotational speed of 12,800 r/min. During machining, the material should be cooled and lubricated using a lubricant, in particular a nano lubricant.

In order to ensure that the bore precisely extends along the longitudinal axis of the contact pin and to prevent the drill from laterally drifting away during the drilling process, it is particularly recommendable to drill the recesses starting from both frontal surfaces. The bore can thereby be created in a gradual fashion. This means in other words that the bore is gradually widened with the aid of different drills having increasingly larger diameters.

In order to be able to readily insert the connection wire of the fluorescent tube into the recess, a particularly large diameter of the recess is desirable. Conversely, it is advantageous if the recess in the contact region between contact pin and connection wire has the smallest possible diameter, since in this way, a very low deformation degree will already suffice for establishing the electrical contact between connection wire and contact pin. In order to fulfill both requirements with respect to a contact pin, the bore of the one axial end of the contact pin should have a diameter larger than that of the bore extending from the opposite frontal surface. As a result, a recess is created in the contact pin, said recess having a region with a larger diameter and a region with a smaller diameter. The region with the larger diameter faces towards the fluorescent tube subsequent to assembly at the fluorescent tube and thusly enables easier insertion of the connection wire. The portion with the smaller diameter faces away from the fluorescent tube and serves for contacting the connection wire in the contact pin.

In order to ensure easy insertion of the connection wire from the section with the larger diameter into the section with a smaller diameter, a conical transition zone should be drilled between the two cylindrical bores using a drill bit. At the conical inner wall of said transition zone, the end of the connection wire can then be inserted into the region of the bore with a smaller diameter starting from the bore with a larger diameter.

The geometry of the conical transition zone between the two bore sections is basically optional. An opening angle of 60° has proven to be particularly suitable, so that in the formation thereof, a drill bit ground at an opening angle of 60° should be employed.

In order to be able to readily fasten the contact pin at the end cap, the bore with the larger diameter should form a wall thickness which can be deformed, in particular riveted, in the region of the one axial end of the contact pin. For assembly of the contact pin at the end cap, said axial end is then inserted into the recess of the end cap and is moved forwards until the protruding collar rests against the wall of the end cap. Subsequently, the end of the contact pin protruding at the inner surface of the end cap is deformed, for example riveted, and the contact pin is thereby fixed at the end cap. Insofar as the outer edges of the contact pin are supposed to be chamfered in order to thusly avoid for instance injuries on the part of the user and to facilitate assembly by means of the insertion chamfer, the outer edges should be chamfered in the course of the machining step by means of a metal-cutting process.

In order to be able to make optimum use of the potentials of the inventive method, in particular with respect to high production efficiency, where for instance a quantity of 135 to 155 items/min is required, a material optimally adapted to the requirements of the production process has to be utilized. Moreover, said material needs to satisfy the requirements in terms of electrical conductivity and in terms of mechanical stability. In order to attain optimum production efficiencies, comprehensive trials with a large variety of different aluminum alloy materials have been carried out. Materials inter alia conforming to designations nos. A199.5 (AW 1050), AlMn1 (AW 3103), AlZn5.5 MgCu (AW 7075) and similar aluminum alloys have been examined. The various examined materials all failed to fully satisfy the necessary requirement profile.

In the course of the trials it has proven that optimal product requirements and an optimal compromise with respect to material costs, electrical properties and mechanical properties can be attained by using aluminum alloys, in particular aluminum wrought alloys, insofar as said aluminum wrought alloys have a minimum aluminum content of 90%, a minimum copper content of 4.5% and/or a minimum magnesium content of 0.5%. Said requirements can be satisfied in particular using aluminum wrought alloys from series 2000 (Al—Cu), aluminum wrought alloys from series 5000 (Al—Mg) or else aluminum wrought alloys from series 6000 (Al—Mg—Si). Insofar as the various material contents are indicated in percent in the present invention, said designations are supposed to refer to weight percent.

The aluminum content of the aluminum alloy should preferably be in the range of 93% to 94%. The copper content in turn should preferably be in the range of 5% to 6%, in particular in the range of 5.4% to 5.6%.

Another enhancement of the machinability of the aluminum alloy material in the two-step processing with a deformation step and a machining step is attained if the aluminum alloy additionally contains bismuth. In the German language bismuth is sometimes also referred to as "Wismut".

In this connection, the bismuth content should be in the range of 0.1% to 0.9%, in particular in the range of 0.2% to 0.6%. Optimum results are attained with a bismuth content of 0.45% to 0.55%.

In the context of the material trials, in particular one aluminum alloy, the quality thereof conforming to material designation AlCu6Bi, has been identified as being particularly suitable.

Moreover, the aluminum alloy should preferably also have a lead content. The lead content should preferably be in the range of 0.2% to 0.6%, in particular in the range of 0.2% to 0.4%.

Insofar as the aluminum alloy composed of aluminum, copper and bismuth additionally also contains lead, the aluminum alloy should conform to a quality in line with material designation AlCu6BiPb. In addition to the indicated contents (aluminum, copper, bismuth, lead), the aluminum alloy may additionally also contain trace amounts of silicon, iron, manganese, magnesium, chromium, zinc and/or titanium.

From the wrought aluminum alloys from series 2000 (Al—Cu), in particular the aluminum alloy conforming to the quality of material designation no. EN AW 2011 is perfectly suited for producing the contact pins with the inventive method. Quality standard designation no. EN AW 2011 contains for instance 5.5% copper, 0.48% bismuth, 0.51% lead, 0.06% silicon, 0.13% iron, 0.01% manganese, 0.01% magnesium, 0.01% chromium, 0.03% zinc and 0.03% titanium. The remainder of the aluminum alloy is formed by aluminum. The aluminum alloy in line with material designation number EN AW 2011 in particular is also specified in Eurocode No. EN 573-3. The aluminum alloy in line with material designation number EN AW 2011A having the somewhat lower minimum copper content of 4.5% is equally well suited.

Alternatively thereto, from the wrought aluminum alloys from series 5000 (Al—Mg), the aluminum alloys in line with material designation numbers EN AW 5019 (AlMg5), EN AW 5754 (AlMg3), EN AW 5154A (AlMg3,5(A)) or else EN AW 5083 (AlMg4,5Mn0,7) are very well suited for producing the contact pins using the inventive method.

Among the aluminum alloys from series 6000 (Al—Mg—Si), the aluminum alloy in line with material designation number EN AW 6082 (AlSi1MgMn) is very well suited for producing the contact pins using the inventive method.

Various aspects of the present invention are schematically illustrated in the drawings and will be exemplarily specified herein below, wherein.

Figure 1:
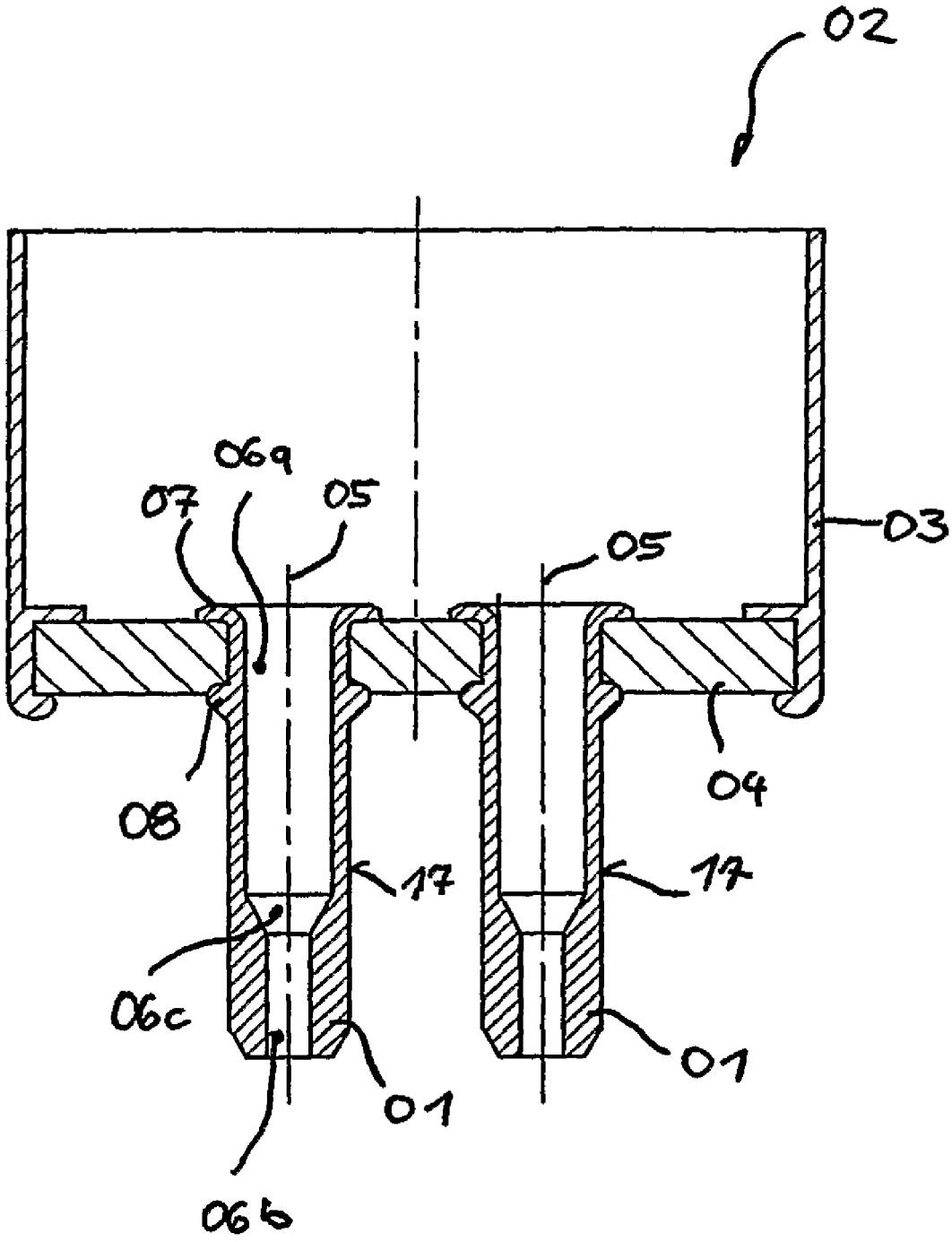
FIG. 1 shows an end cap for arrangement at an axial end of a fluorescent tube with two contact pins in a cross-sectional view.

FIG. 1 shows in a cross-sectional view two contact pins 01 for electrically contacting a fluorescent tube by arrangement in a base bracket. Here the two contact pins 01 are produced from an aluminum alloy conforming to the quality specified by material designation no. AW 2011 (Eurocode no. EN 573-3). In order to be able to fasten the two contact pins 01 at a fluorescent tube, the contact pins are mounted at a cup-shaped end cap 02. The end cap 02 in turn is inserted at an axial end of the glass body of the fluorescent tube and is fastened in this position. The end cap 02 is composed of a cylindrical sleeve 03 and a frontal cap 04 which is made of an electrically insulating material, for instance plastics. At the outer wall of the contact pin a cylindrical contact region 17 is provided, which is engageable in a base bracket of the fluorescent tube by establishing an electrical contact between the base bracket and the fluorescent tube.

The two contact pins 01 each have a recess 06 continuously extending along the longitudinal axis 05 thereof from one axial end to the other axial end. In said recesses 06 a connection wire of the fluorescent tube is respectively inserted and electrically contacted by crimping the contact pins 01. The recess 06 has a region 06*a* with a large diameter, a region 06*b* with a small diameter and a conical transition zone 06*c*. The connection wire of the fluorescent tube is inserted into region 06*b* and is electrically contacted therein.

For fastening the contact pins 01 at the frontal cap 04, the axial ends 07 which face towards the fluorescent tube and which have an outer and inner diameter initially corresponding to the outer and inner diameters in region 06*a* are riveted. In order to ensure fastening of the contact pins 01 by means of the riveting process, a collar 08 is additionally formed at the outer circumference, the collar 08 resting against the outer surface of the frontal cap 04. With the aid of the collar 08 and the riveted axial end 07, the contact pin 01 is fixed in the recess of the frontal cap 04 in a form-fitting manner.

Figure 2:
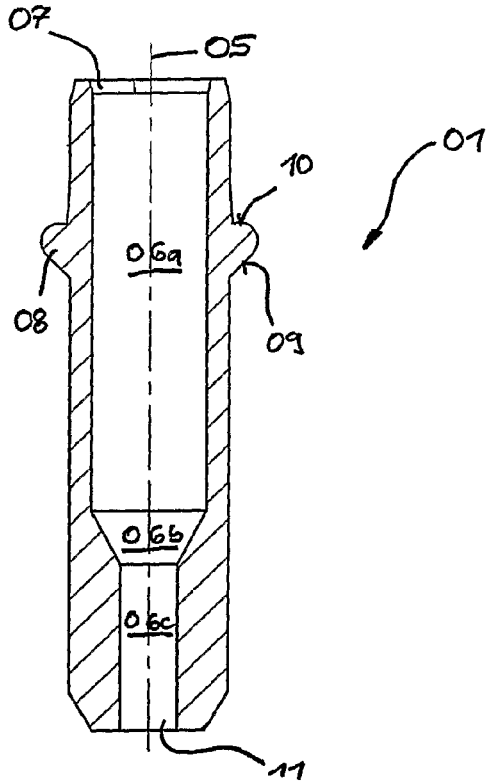
FIG. 2 shows a contact pin according to FIG. 1 in an enlarged cross-sectional view.

FIG. 2 illustrates the contact pin 01 with regions 06*a*, 06*b* and 06*c* of recess 06 with not yet riveted axial end 07 and collar 08 in an enlarged view. Here the collar 08 has a conically-shaped flank 09 and a planar-shaped flank 10. The planar flank 10 rests against the outer surface of the frontal cap 04. In the region of axial end 07 and in the region of axial end 11, the outer and inner edges are chamfered. Here the wall thickness of the contact pin 01 in the region of axial end 07 is selected in such a manner that the axial end 07 for fastening the contact pin 01 at the frontal cap 04 can be riveted.

Figure 3:
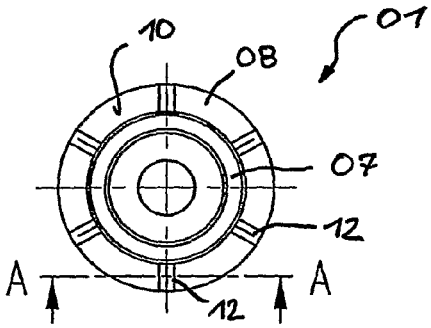
FIG. 3 shows the contact pin according to FIG. 2 in a plan view.
Figure 4:
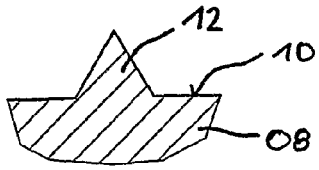
FIG. 4 shows the contact pin according to FIG. 3 along intersection line A-A.

FIG. 3 shows the contact pin 01 with protruding collar 08 in the viewing direction from axial end 07. On the planar flank 10 of the collar 08 six protruding teeth 12 are formed which become embedded in the material of the frontal cap 04 in a form-fitting manner when the axial end 07 is riveted, and which prevent twisting of the contact pins 01. The geometry of the teeth 12 is apparent from the cross-section according to FIG. 4.

Figure 5:
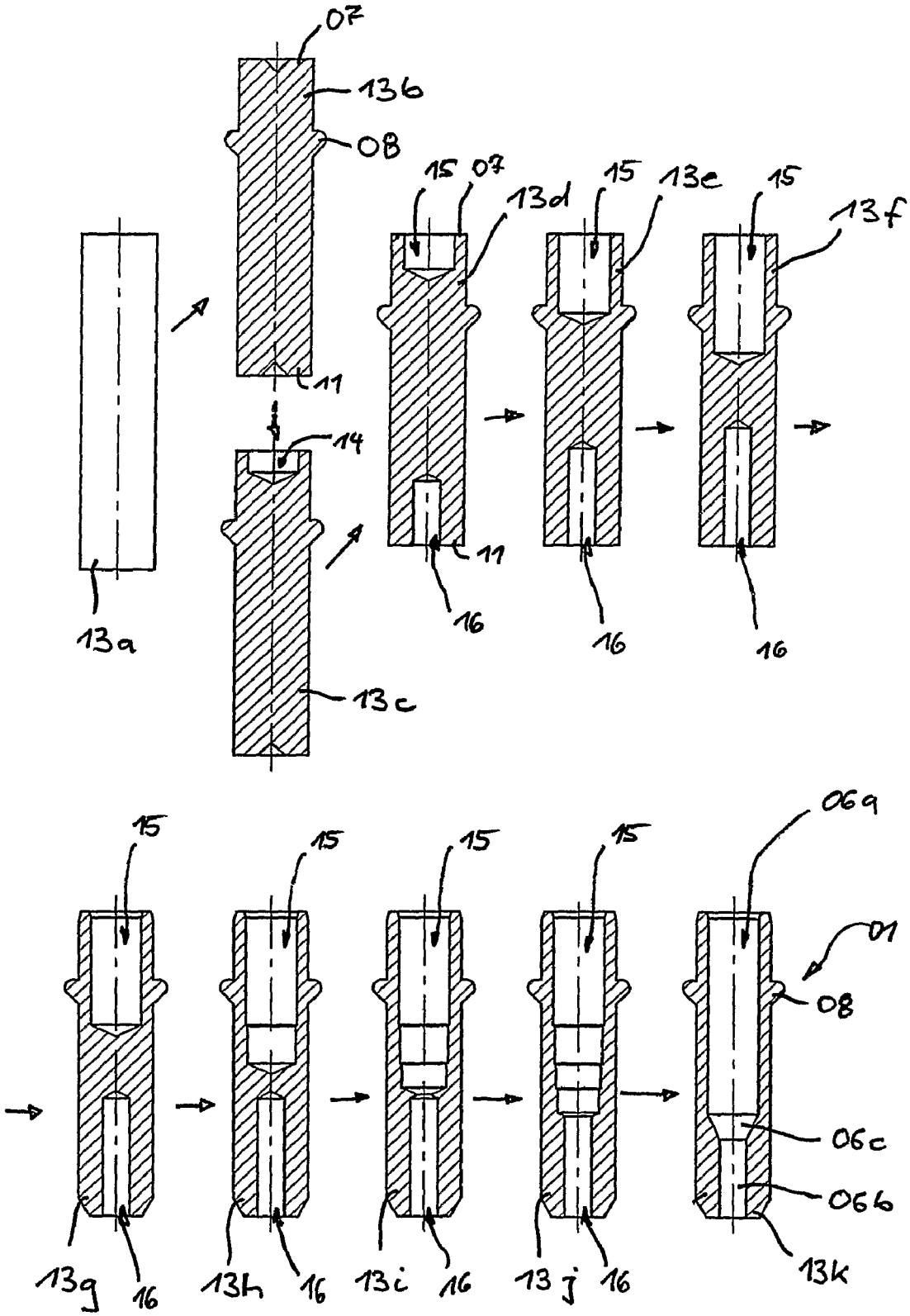
FIG. 5 shows the production of a contact pin according to FIG. 2 using a combination of a deformation process and a machining process.

FIG. 5 shows the production of contact pin 01 at different process steps. Initially, in a first step, a section of a predetermined length of a wire material is cut to length. Subsequently, the cut-to-length semi-finished metal product is subjected to a one-step or two-step cold deformation process. In the deformation process, the collar 08 is formed so that the material protrudes beyond the outer circumference of the wire having an outer circumference corresponding to the outer circumference of the contact pin 06. Moreover, in the deformation process a cup 14 is formed at the axial end 07 by backward extrusion. Here the cup 14 forms the first part of the recess 06.

For producing the recess 06 with regions 06*a*, 06*b* and 06*c* thereof, the semi-finished metal product 13 is subsequently machined in eight process steps. In the first three machining steps, bores 15 and 16 are formed at axial ends 07 and 11 in a gradual fashion with the aid of fast rotating drills.

Subsequent to the first three steps for producing recess 06 by means of bores 15 and 16, the axial edges 07 and 11 are chamfered and the edges are fractured. Then, the bore 15 is deepened in three further process steps, wherein different drills each with gradually decreasing outer diameters are employed. In the ultimate processing step, using a drill with a drill bit ground at an opening angle of 60° the inner contour is finish-drilled and the conical transition zone 06*c* is thereby formed by the drill bit.

LIST OF REFERENCE NUMERALS

01 Contact pin
02 End cap
03 Sleeve
04 Frontal cap
05 Longitudinal axis
06 Recess
07 Axial end
08 Collar
09 Conical flank
10 Planar flank
11 Axial end
12 Tooth
13 Cut-to-length semi-finished metal product
14 Cup
15 Bore
16 Bore
17 Cylindrical contact region

The invention claimed is:

1. A method for producing a contact pin for use as an electric contact element of a fluorescent tube, wherein the contact pin has a recess extending along the longitudinal axis thereof, wherein a connection wire of the fluorescent tube can be inserted into said recess and can be electrically connected to the contact pin, wherein the outer wall of the contact pin has a cylindrical contact region having a diameter and which can be engaged in a base bracket of the fluorescent tube in order to establish an electrical contact between the base bracket and the fluorescent tube, and wherein the outer wall of the contact pin has an annular collar with which the contact pin rests against a wall of an end cap when inserted into a recess of the end cap which is provided on the axial end of the fluorescent tube, said method comprising:

a) cutting to length a semi-finished metal product composed of an aluminum alloy and which has a diameter corresponding to the diameter of the cylindrical contact region;

b) deforming the cut-to-length semi-finished metal product to form the collar protruding beyond the diameter of the cylindrical contact region; and c) machining the deformed semi-finished metal product to form the recess.

2. The method according to claim 1, in which the cut-to-length semi-finished metal product is deformed by means of cold deformation in order to form the protruding collar.

3. The method according to claim 1, in which the protruding collar is deformed on one side with a conical flank and on an opposite side with one of a planar flank and a second conical flank, wherein the one of the planar flank and the second conical flank rests against the wall of the end cap.

4. The method according to claim 3, in which protruding teeth are deformed on the planar flank of the collar, which engage on the wall of the end cap in a form-fitting and force-fitting manner.

5. The method according to claim 1, in which prior to the start of the machining, at least one frontal surface of the semi-finished metal product is deformed in order to create a part of the recess in the form of a cup.

6. The method according to claim 1, in which the semi-finished metal product is machined by means of drilling at a rotational speed of more than 10,000 r/min to form the recess.

7. The method according to claim 6, in which the recess is formed by drilling a first bore and a separate second bore starting from the two frontal surface axial ends of the semi-finished metal product.

8. The method according to claim 7, in which the first bore has a diameter larger than that of the second bore.

9. The method according to claim 8, in which a conical transition zone is created by drilling with the aid of a drill bit to connect the first bore and the second bore.

10. The method according to claim 9, in which a drill bit ground at an opening angle of 60 degree is used.

11. The method according to claim 8, in which by means of the first bore, a wall thickness which can be deformed for securing the contact pin at the end cap is formed in the region of the one axial end of the contact pin.

12. The method according to claim 1, in which during machining, the outer edges of the semi-finished metal product are chamfered at the frontal surface axial ends.

13. A contact pin for use as an electric contact element of a fluorescent tube, wherein the contact pin comprising:

a recess extending along the longitudinal axis thereof, wherein a connection wire of the fluorescent tube can be inserted into said recess and can be electrically connected to the contact pin, wherein an outer wall of the contact pin has a cylindrical contact region which can be engaged in a base bracket of the fluorescent tube in order to establish an electrical contact between the base bracket and the fluorescent tube, and wherein the outer wall of the contact pin has an annular collar with which the contact pin rests against the wall of an end cap when inserted into a recess of the end cap which is provided on the axial end of the fluorescent tube, the contact pin being made of a wrought aluminum alloy, wherein the aluminum alloy has at least one of a minimum aluminum (Al) content of 90%, a minimum copper (Cu) content of 4.5%, and a minimum magnesium (Mg) content of 0.5%.

14. The contact pin according to claim 13, in which the aluminum alloy has an aluminum content in the range of 93% to 94%.

15. The contact pin according to claim 13, in which the aluminum alloy has a copper content in the range of 5% to 6%, in particular a copper content in the range of 5.4% to 5.6%.

16. The contact pin according to claim 13, in which the aluminum alloy contains bismuth (Bi).

17. The contact pin according to claim 16, in which the aluminum alloy has a bismuth content in the range of 0.1% to 0.9%, in particular a bismuth content in the range of 0.2% to 0.6%.

18. The contact pin according to claim 13, in which the aluminum alloy contains lead (Pb).

19. The contact pin according to claim 18, in which the aluminum alloy has a lead content in the range of 0.2% to 0.6%, in particular a lead content in the range of 0.2 to 0.4%.

20. The contact pin according to claim 19, in which the aluminum alloy has a quality conforming to material designation AlCu6BiPb.

21. The contact pin according to claim 13, in which the aluminum alloy contains trace amounts of silicon (Si), in particular in the range of 0.01% to 0.09%.

22. The contact pin according to claim 13, in which the aluminum alloy contains trace amounts of iron (Fe), in particular in the range of 0.05% to 0.25%.

23. The contact pin according to claim 13, in which the aluminum alloy contains trace amounts of manganese (Mn), in particular in the range of 0.05% to 0.15%.

24. The contact pin according to claim 13, in which the aluminum alloy contains trace amounts of magnesium (Mg), in particular in the range of 0.05% to 0.15%.

25. The contact pin according to claim 13, in which the aluminum alloy contains trace amounts of chromium (Cr), in particular in the range of 0.0005% to 0.0015%.

26. The contact pin according to claim 13, in which the aluminum alloy contains trace amounts of zinc (Zn), in particular in the range of 0.001% to 0.005%.

27. The contact pin according to claim 13, in which the aluminum alloy contains trace amounts of titanium (Ti), in particular in the range of 0.01% to 0.05%.

28. The contact pin according to claim 13, in which the aluminum alloy comprises a material comprising A1Cu6BiPB.

29. The contact pin according to claim 13, in which the aluminum alloy comprises a material selected from the group consisting of A1Mg5, A1Mg3, AlSi1MgMn, AlMg3.5(A), and A1Mg4.5Mn0.7.

* * * * *